US009027217B2

(12) United States Patent
Cranford et al.

(10) Patent No.: US 9,027,217 B2
(45) Date of Patent: May 12, 2015

(54) BLOWOUT PREVENTER HEAD REMOVAL TOOLS AND METHODS

(75) Inventors: Kathyleen Cranford, Garrison, TX (US); Bobby Dale Cranford, Garrison, TX (US)

(73) Assignee: Triple C Rig Welding, LLC, Garrison, TX (US)

( * ) Notice: Subject to any disclaimer, the term of this patent is extended or adjusted under 35 U.S.C. 154(b) by 275 days.

(21) Appl. No.: 13/495,230

(22) Filed: Jun. 13, 2012

(65) Prior Publication Data

US 2013/0025105 A1 Jan. 31, 2013

Related U.S. Application Data

(60) Provisional application No. 61/511,832, filed on Jul. 26, 2011.

(51) Int. Cl.

| | |
|---|---|
| ***B23P 19/04*** | (2006.01) |
| ***E21B 19/00*** | (2006.01) |
| *E21B 19/16* | (2006.01) |
| *E21B 33/064* | (2006.01) |

(52) U.S. Cl.

CPC ..... *E21B 19/00* (2013.01); *Y10T 29/53* (2015.01); *Y10T 29/49815* (2015.01); *Y10T 29/49826* (2015.01); *E21B 19/16* (2013.01); *E21B 33/064* (2013.01)

(58) Field of Classification Search

CPC ..... E21B 19/16; E21B 33/064

USPC ..... 29/255, 256, 258, 266, 426.1; 166/381, 166/387; 81/2, 3.45, 121.1, 177.7, 177.4, 81/176.2, 176.15, 450, 58.1, 57.5

See application file for complete search history.

(56) References Cited

U.S. PATENT DOCUMENTS

| | | | | |
|---|---|---|---|---|
| 3,737,974 | A | | 6/1973 | Mott |
| 3,909,916 | A | | 10/1975 | Neff et al. |
| 4,125,164 | A | | 11/1978 | Terry |
| 4,133,342 | A | | 1/1979 | Carnahan |
| 4,213,235 | A | | 7/1980 | Kemmerling |
| 4,305,467 | A | | 12/1981 | Villines |
| 4,326,584 | A | | 4/1982 | Watkins |
| 4,398,598 | A | | 8/1983 | Fabrygel |
| 4,406,333 | A | | 9/1983 | Adams |
| 4,456,215 | A | | 6/1984 | Bishop et al. |
| 4,504,037 | A | | 3/1985 | Beam et al. |
| 4,813,730 | A | | 3/1989 | Terral |
| 4,997,225 | A | | 3/1991 | Denis |
| 5,167,288 | A | | 12/1992 | McNeil et al. |
| 5,199,683 | A | | 4/1993 | Le |
| 5,467,833 | A | | 11/1995 | Crain |
| 5,709,018 | A | | 1/1998 | Dugan |
| 5,816,565 | A | | 10/1998 | McGuffin |
| 5,924,342 | A | * | 7/1999 | Chou ..... 81/120 |
| 5,957,431 | A | | 9/1999 | Serda, Jr. |
| 6,053,255 | A | | 4/2000 | Crain |

(Continued)

*Primary Examiner* — Joseph J Hail
*Assistant Examiner* — Jamal Daniel
(74) *Attorney, Agent, or Firm* — R. Johnston Law, PLLC

(57) ABSTRACT

Specialized tools and methods are presented for use on blowout preventers on oil and gas rigs. The specialized tools releseably attach to a threaded, blowout-preventer head to remove the same. In one instance, the tool has a longitudinal shaft, a lifting eye member at one end and a head-mounting member at the other. The head-mounting member attaches to the threaded, blowout-preventer head. In some instances, one or more torque arms may be included to add additional torque. Other embodiments and methods are also included.

6 Claims, 4 Drawing Sheets

(56) References Cited

U.S. PATENT DOCUMENTS

| | | | | |
|---|---|---|---|---|
| 6,244,631 | B1 | 6/2001 | Payne et al. | |
| 6,260,451 | B1 * | 7/2001 | Mirabito | 81/176.15 |
| 6,343,532 | B1 * | 2/2002 | Lucy | 81/177.6 |
| 6,385,846 | B1 | 5/2002 | Hayashi | |
| 6,554,247 | B2 | 4/2003 | Berckenhoff et al. | |
| 6,840,326 | B2 | 1/2005 | Shiyou | |
| 7,040,411 | B2 | 5/2006 | Kainer et al. | |
| 7,086,474 | B1 | 8/2006 | Trevithick et al. | |
| 7,328,750 | B2 | 2/2008 | Swor et al. | |
| 7,357,187 | B2 | 4/2008 | Gass | |
| 7,591,318 | B2 | 9/2009 | Tilghman | |
| 7,802,626 | B2 | 9/2010 | Hemphill et al. | |
| 2002/0121792 | A1 | 9/2002 | Worthington | |
| 2004/0168831 | A1 | 9/2004 | Nozaki et al. | |
| 2009/0031867 | A1 * | 2/2009 | Andronica et al. | 81/436 |

* cited by examiner

BLOWOUT PREVENTER HEAD REMOVAL TOOLS AND METHODS

RELATED APPLICATION

The present application claims the benefit, under 35 U.S.C. §119(e), of the filing of U.S. Provisional Patent Application Ser. No. 61/511,832, entitled "Annular Seal Removing Tool Using Top Drive or Kelly," filed Jul. 26, 2011, and which incorporated herein by reference for all purposes.

FIELD

The disclosure herein relates to blowout preventers for use on oil rigs, and more particularly, but not by way of limitation, to blowout preventer head removal tools and methods.

BACKGROUND

In the early years of oil production it was not uncommon for a blowout on an oil well being drilled to occur. A blowout is an uncontrolled release of oil from an oil well or gas from a gas well. One may think of the classic picture of a gusher at Spindletop, Tex. throwing oil out of the top. Blowouts are both dangerous and wasteful. Blowouts would often push the drill string out of the well and injure or kill workers.

With the advent of rotary drilling techniques, which use the density of the drilling fluid, or "mud," to overcome the downhole pressure of a penetrated zone, gushers became less frequent. At times, however, the fluid density was not adequate and a blowout would still occur. In the 1920s, blowout preventers (BOP) were developed to regulate the pressure at or near the wellhead and they soon became standard equipment. In recent times, blowout preventers have entered the news because of the alleged failure of the 300-ton blowout preventer on the Deepwater Horizon well off the coast of Louisiana. Three main manufacturers of blowout preventers today are Hydril, Cameron, and Shaffer.

In modern drilling operations, drill strings are placed through a blowout preventer stack before running toward the oil and gas reservoir. The drilling fluid (mud) is pumped through the drill string down to the drill bit and then returns up the space (annulus) between the outside of the drill pipe and the casing. When an excessive influx of pressure enters from the reservoir, automated systems or an operator activates the blowout preventer and the blowout preventer seals the annulus and stops the flow of fluids.

Because blowout preventers are so important to safety and protection of the environment, regulations and practices require that blowout preventers be inspected on a regular basis. For example, after drilling a well, the blowout preventer is typically tested to make sure that there are no leaks. Depending one wear and circumstances, the seals within the blowout preventer are replaced. To replace the seals, the blowout preventer is opened, and in particular the annular BOP head is removed. Conventionally, the studs in the annular head are turned manually using a pipe through the studs on the annular head and with the workers suspended in a basket. The process is more dangerous, difficult, and time consuming than desired.

SUMMARY

According to an illustrative embodiment, a tool for removing a threaded, blowout-preventer head using a rotating device includes a longitudinal shaft having a first end and a second end, a lifting eye member coupled to the first end of the shaft, and a head-mounting member having a first side and a second side. The head-mounting member is coupled to the second end of the longitudinal shaft. The head-mounting member includes a plurality of apertures for receiving a plurality of studs on the threaded, blowout preventer head. The shaft and head-mounting member have a combined longitudinal length that allows a rotating device to be coupled to a portion of the shaft in order to rotate the shaft and remove the blowout preventer head.

According to another illustrative embodiment, a method for removing a threaded, blowout-preventer head from a blowout preventer includes providing a tool for removing the threaded, blowout-preventer head using a rotating device. The tool includes a longitudinal shaft having a first end and a second end, a lifting eye member coupled to the first end of the shaft, and a head-mounting member having a first side and a second side. The head-mounting member is coupled to the second end of the longitudinal shaft. The head-mounting member includes a plurality of apertures for receiving a plurality of studs on the blowout preventer head. The method further includes positioning the second side of the head-mounting member proximate to a first side of the threaded, blowout-preventer head; bolting the head-mounting member to the threaded, blowout-preventer head; providing a rotating device, wherein the shaft and head-mounting member have a combined longitudinal length that allows the rotating device to be coupled to a portion of the shaft in order to rotate the shaft and remove the blowout preventer head; coupling the rotating device to a portion of the shaft; and using the rotating device to rotate the shaft to cause the threaded, blowout-preventer head to be unscrewed from a mating portion of the blowout preventer.

According to another illustrative embodiment, a tool for removing a threaded, blowout-preventer head using a rotating device includes: a longitudinal shaft having a first end and a second end, wherein the shaft is at least 8 feet (2.4 meters) long and is less than 25 feet (7.62 meters) long, wherein the shaft is a pipe having an outside diameter greater than four inches (10.2 centimeters) and less than 10 inches (25.4 centimeters) and a wall thickness greater than ½ inch (1.3 inches) and less than three inches (7.6 centimeters); a lifting eye member coupled to the first end of the shaft, wherein the lifting eye member comprises a lifting eye plate coupled to a base plate; a head-mounting member having a first side and a second side, wherein the head-mounting member is coupled to the second end of the longitudinal shaft, wherein the head-mounting member includes a plurality of apertures for receiving a plurality of studs on the blowout preventer head; wherein the shaft and head-mounting member have a combined longitudinal length that allows a rotating device to be coupled to a portion of the shaft in order to rotate the shaft and remove the blowout preventer head; wherein the head-mounting member comprises: a mounting plate having the plurality of apertures and having a first side and a second side, a plurality of gussets having a first edge and a second edge, wherein the second edges of the plurality of gussets are coupled to the first side of the mounting plate, and a torque plate having a first side and a second side, wherein the first edges of the plurality of gussets are coupled to the second side of the torque plate; a first torque arm pivotally coupled to the first side of the head-mounting member, the first torque arm having a first end and a second end; a second torque arm pivotally coupled to the first side of the head-mounting member and spaced approximately 180 degrees from the first torque arm, the second torque arm having a first end and a second end; an anchor bar coupled to a medial portion of the shaft on an exterior, the anchor bar having a first extension with an aperture and as second extension with an aperture; wherein the first end of the first torque arm has an aperture and a first anchor shackle in the aperture, wherein the first send of the second torque arm has an aperture and a second anchor shackle in the aperture; wherein the second end of the first torque arm is coupled to a first hinge that is coupled to the first side of the head-mounting member; wherein the second end of the second torque arm is coupled to a second hinge that is coupled to the first side of the head-mounting member; wherein the anchor bar is positioned and configured such that the aperture in the first extension mates with the first anchor shackle on the first torque arm to hold the first torque arm in a stored position and configured so that the aperture in the second extension mates with the second anchor shackle on the second torque arm to hold the second torque arm in a stored position; wherein a first plurality of apertures is formed proximate the second end of the first torque arm for aligning with a first plurality of apertures formed in the torque plate when the tool is in the torque position; wherein a second plurality of apertures is formed proximate the second end of the second torque arm for aligning with a second plurality of apertures formed in the torque plate when the tool is in the torque position; a first plurality of brace members coupled to the first side of the head-mounting member to form a first torque-arm-receiving channel for receiving a portion of the first torque arm when the tool is in a torque position; and a second plurality of brace members coupled to the first side of the head-mounting member to form a second torque-arm-receiving channel for receiving a portion of the second torque arm when the tool is in a torque position.

Other features and advantages of the illustrative embodiments will become apparent with reference to the drawings and the detailed description that follow.

BRIEF DESCRIPTION

Illustrative embodiments are described in detail below with reference to the attached drawing figures, which are incorporated by reference herein and wherein.

Figure 5:
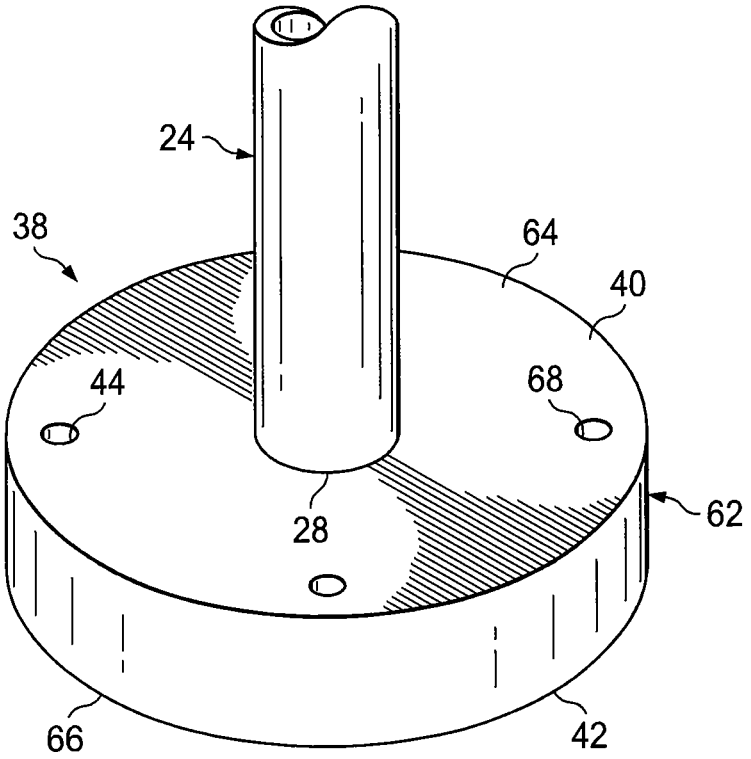
Figure 6:
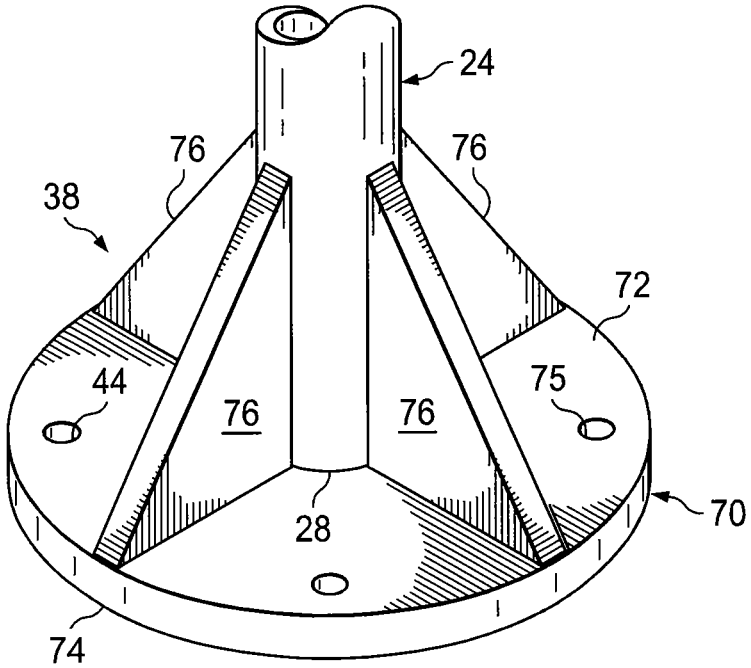

FIG. 5 is a schematic, perspective view of a portion of an illustrative embodiment of a tool for removing a threaded, blowout-preventer head using a rotating device showing an illustrative embodiment of a head-mounting member; and FIG. 6 is a schematic, perspective view of a portion of an illustrative embodiment of a tool for removing a threaded, blowout-preventer head using a rotating device showing an illustrative embodiment of a head-mounting member.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
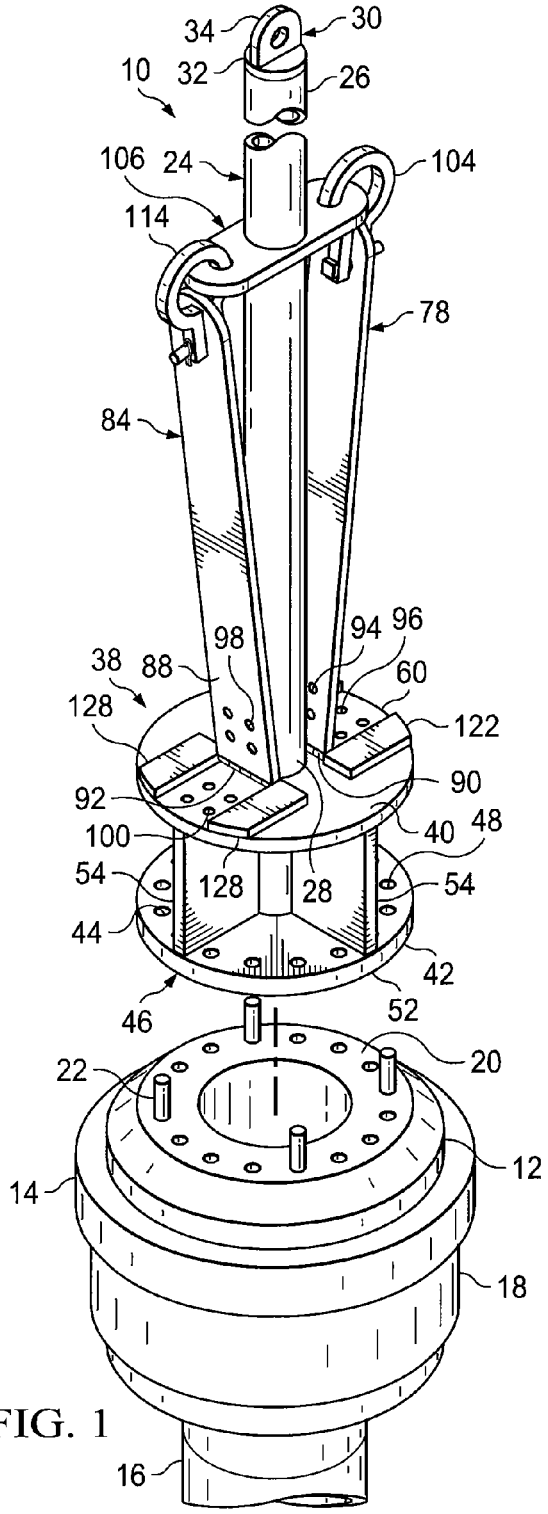
FIG. 1 is a schematic, perspective view of an illustrative embodiment of a tool for removing a threaded, blowout-preventer head using a rotating device and showing an illustrative blowout preventer.

Referring now to the drawings and initially to FIG. 1, an illustrative embodiment of a tool 10 for removing a threaded, blowout-preventer head 12, or annular head, of a blowout preventer 14 using a rotating device on a rig, e.g., a top drive, kelly, or rotary table is presented. The tool 10 allows the threaded, blowout-preventer head 12 to be removed from the blowout preventer 14 quickly and easily.

In a typical oil rig, the casing extends from the wellhead into the ground and the drill string 16 with a drill bit is placed through the casing and into the ground. Usually on top of the wellhead is at least one blowout preventer 14 as previously discussed. The drilling platform is over that with the derrick extending vertically to facilitate the addition of the drill string 16.

There are a number of manufacturers of blowout preventers. For illustration purposes, a HYDRIL blowout preventer, e.g., a GK or GX Series blowout preventer, is presented. It should be understood that the tool 10 could be used with any blowout preventer 14 having a threaded, blowout preventer head 12 that is removed for gaining access to an interior portion and some BOP without threads. The blowout preventer 14 has a body 18. In FIG. 1, the tool 10 is shown aligned with a first side 20 of the threaded, blowout preventer head 12. A plurality of studs 22 extends from the threaded, blowout preventer head 12. In FIG. 1, four studs 22 are shown but more or less may involved at the time the threaded, blowout preventer head 12 is to be removed.

Figure 3:
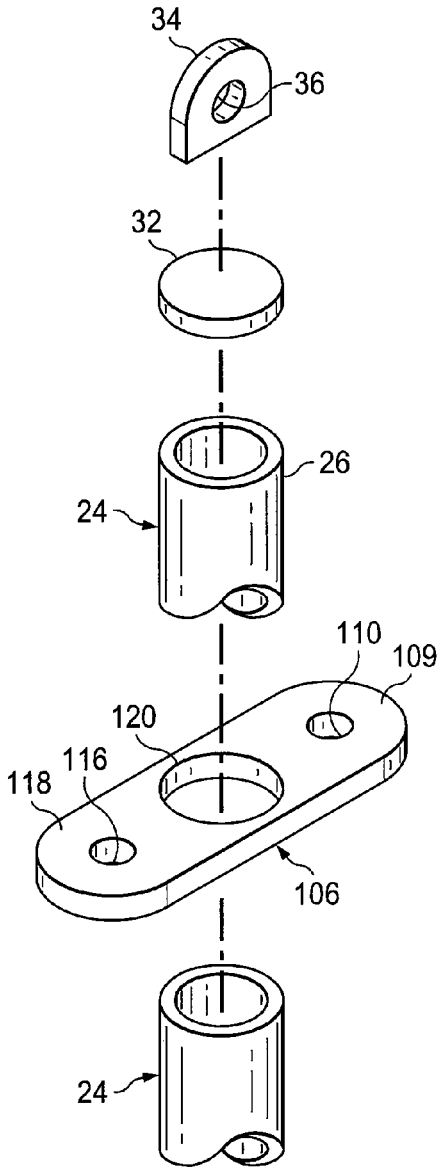
FIG. 3 is a schematic, exploded, perspective view of a portion of an illustrative embodiment of a tool for removing a threaded, blowout-preventer head using a rotating device.

The tool 10 includes a longitudinal shaft 24 having a first end 26 and a second end 28. The longitudinal shaft 24 may be a pipe shaft or could be a solid shaft. The shaft 24 may take any appropriate size, but in one embodiment is between five feet (1.52 meters) and 20 feet (6.1 meters) in length. A lifting eye member 30 is coupled, e.g., welded or drilled and tapped with a bolt, to the first end 26 of the shaft 24. The lifting eye member 30 may be any device to facilitate lifting of the tool 10 using an air hoist line, main hoist, elevator, or other lifting device. For example, as shown in FIG. 3, the lifting eye member 30 may be formed by coupling a base plate 32 to the first end 26 of the shaft 24 and perpendicularly coupling a lifting eye plate 34 to the base plate 32. The lifting eye plate 34 includes an aperture 36 for receiving a lifting hook or other device. The tool 10 also includes a head-mounting member 38.

Figure 2:
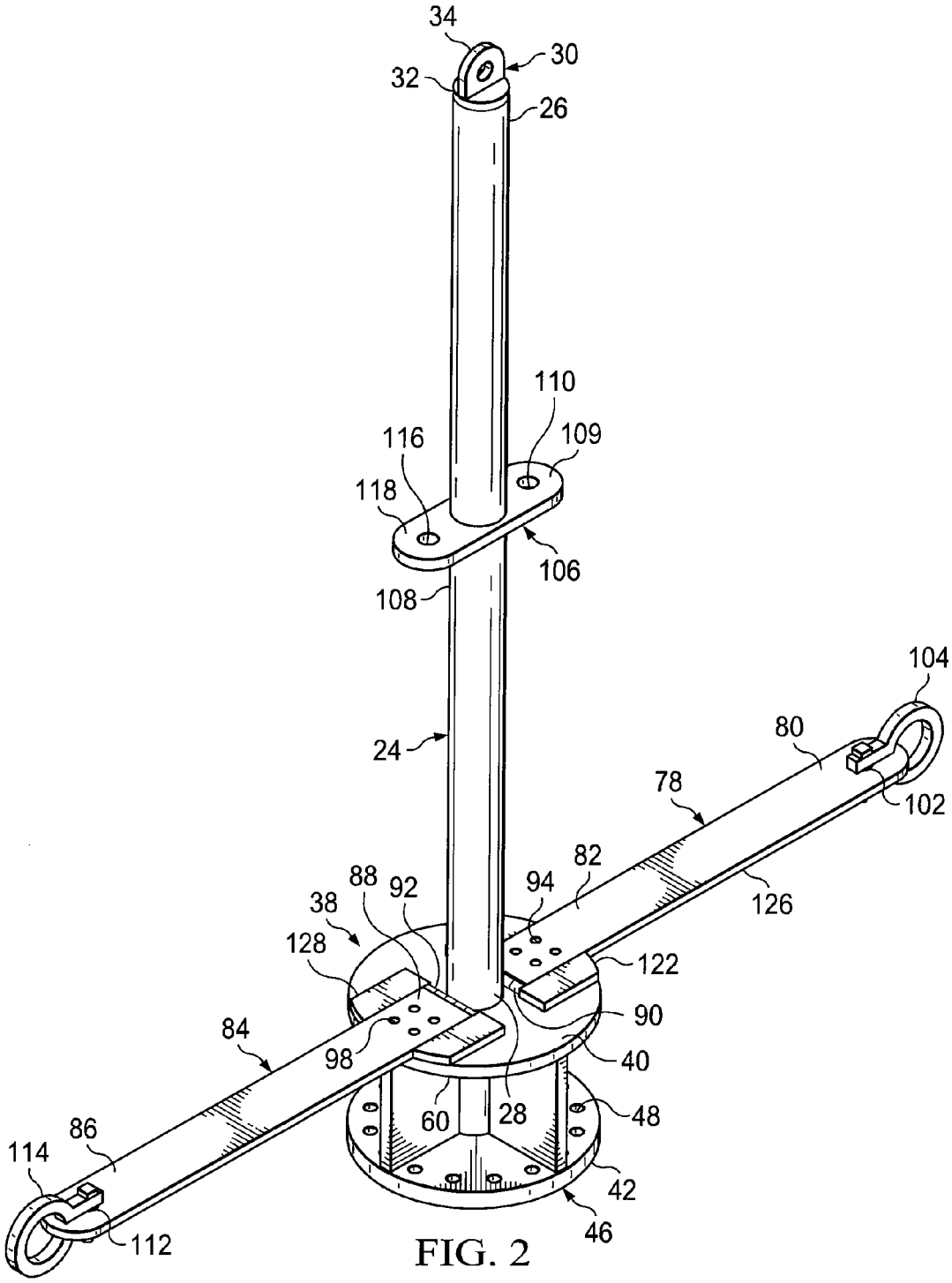
FIG. 2 is a schematic, perspective view of the tool of FIG. 1 shown in a torque position.

The head-mounting member 38 has a first side 40 and a second side 42. The first side 40 of the head-mounting member 38 is coupled to the second end 28 of the longitudinal shaft 24 in some embodiments (FIG. 5) or as shown in FIGS. 1-2, the shaft 24 may extend into the head-mounting member 38 and be coupled to a mounting plate 46. The head-mounting member 38 includes a plurality of apertures 44 for receiving the plurality of studs 22 on the threaded, blowout preventer head 12. The apertures 44 may have the same spacing and be the same number as possible studs 22 on the threaded, blowout preventer head 12 or a lesser number in some embodiments. The head-mounting member 38 may take numerous configurations and three illustrative embodiments are shown in FIGS. 4, 5, and 6 as will be described.

Figure 4:
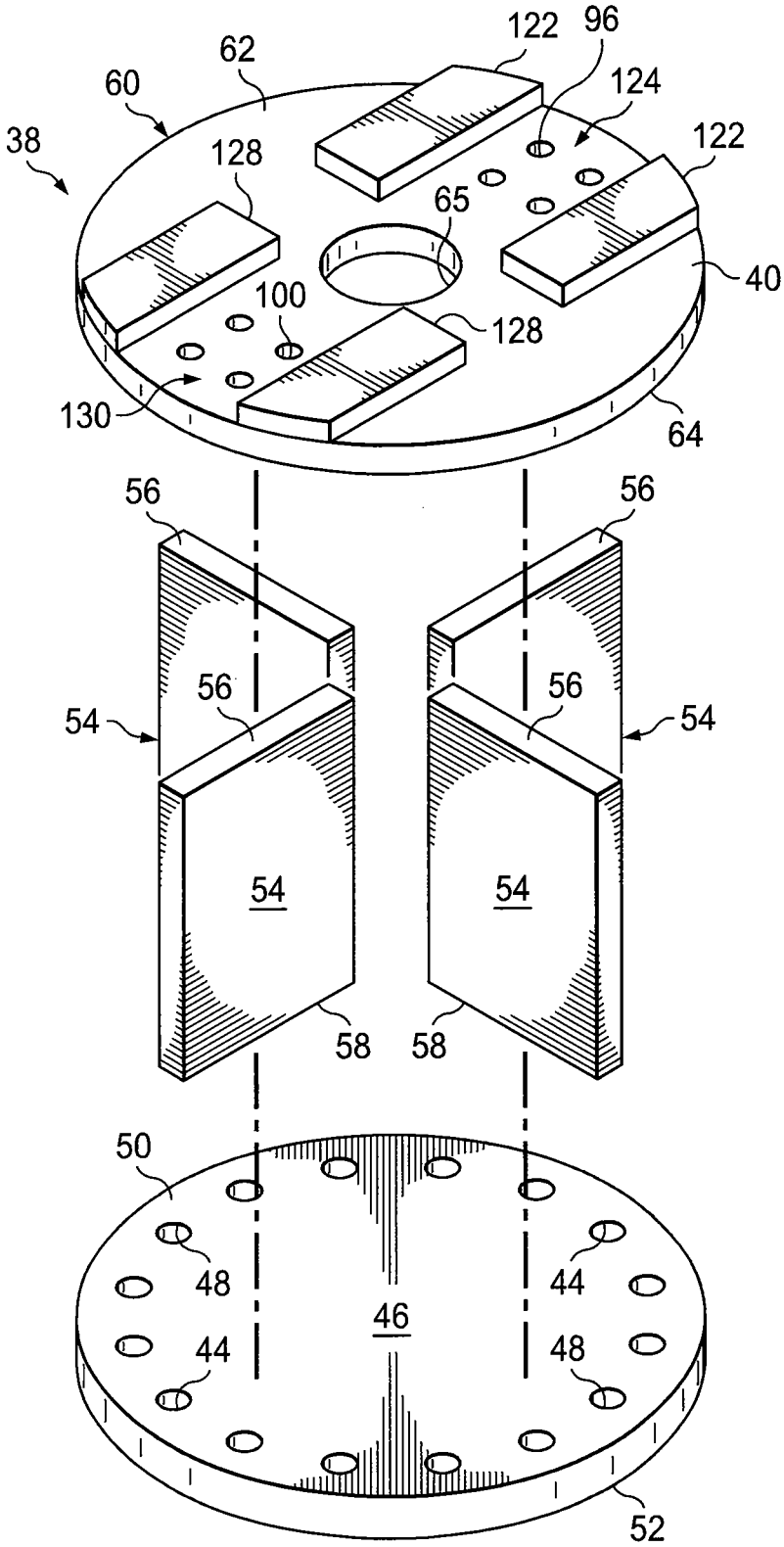
FIG. 4 is a schematic, exploded, perspective view of a portion of an illustrative embodiment of a tool for removing a threaded, blowout-preventer head using a rotating device showing an illustrative embodiment of a head-mounting member.

Referring now primarily to FIGS. 1-2 and 4, one illustrative embodiment of the head-mounting member 38 is now presented. In this embodiment, the head-mounting member 38 includes a mounting plate 46 having the plurality of apertures 48 and having a first side 50 and a second side 52. The head-mounting member 38 also includes a plurality of gussets 54 having a first edge 56 and a second edge 58. The second edges 58 of the plurality of gussets 54 are coupled to the first side 50 of the mounting plate 46. The head-mounting member 38 also includes a torque plate 60 having a first side 62 and a second side 64. The first edges 56 of the plurality of gussets 54 are coupled to the second side 64 of the torque plate 60. The shaft 24 extends through a central aperture 65 in the torque plate 60 and is coupled to the first side 50 of the mounting plate 46. In one illustrative embodiment, the mounting plate 46 is separated from the torque plate 60 by at least 10 inches (25.4 centimeters) and less than 30 inches (76.2 centimeters) and may take any dimension there between, e.g., 16 inches.

Referring now primarily to FIG. 5, another illustrative embodiment of the head-mounting member 38 is presented. The head-mounting member 38 includes a solid disc member 62 having a first side 64 and a second side 66 and a plurality of apertures 68 extending through the solid disc member 62. The second end 28 of the shaft 24 is coupled to the first side 64 of the solid disc member 62.

Referring now primarily to FIG. 6, another illustrative embodiment of the head-mounting member 38 is presented. The head-mounting member 38 includes a base mounting plate 70 having a first side 72, a second side 74, and apertures 75. The second end 28 of the shaft 24 is welded to the first side 72 of the base mounting plate 70. A plurality of triangular gussets 76 are coupled to the base mounting plate 70 and to an exterior of the shaft 24. The gussets 76 could take other shapes, such as, an arcuate member.

Regardless of the specific embodiment of the head-mounting member 38, the shaft 24 and head-mounting member 38 have a combined longitudinal length that allows a rotating device, e.g., top drive, kelly, or rotary table, to be coupled to a portion of the shaft 24 in order to rotate the shaft 24 and remove the blowout preventer head 12.

Referring again to FIGS. 1-2, one or more torque arms, e.g., a first torque arm 78 and a second torque arm 84, may be pivotally coupled to the head-mounting member 38. In this embodiment, the first torque arm 78 is spaced approximately 180 degrees away from the second torque arm 84. More arms might be used and spaced equally or in patterns. The first torque arm 78 has a first end 80 and a second end 82, and the second torque arm 84 has first end 86 and a second end 88. The second end 82 of the first torque arm 78 is pivotally coupled to the head-mounting member 38 by a first hinge 90. Likewise, the second end 88 of the second torque arm 84 is pivotally coupled to the head-mounting member 38 by a second hinge 92.

For the embodiment of FIGS. 1-2, a plurality of apertures 94 are formed proximate the second end 82 of the first torque arm 78 and are aligned with a plurality of apertures 96 in the torque plate 60. When in the torque position, the first torque arm 78 is pivoted to be substantially perpendicular to the shaft 24 as shown in FIG. 2 and bolts (not explicitly shown) may be placed through the apertures 94, 96 and secured. Likewise, a plurality of apertures 98 are formed proximate the second end 88 of the second torque arm 84 and are aligned with a plurality of apertures 100 in the torque plate 60. When in the torque position, the second torque arm 84 is pivoted to be substantially perpendicular to the shaft 24 as shown in FIG. 2 and bolts (not explicitly shown) may be placed through the apertures 98, 100 and secured. Operators may then apply a turning force on the torque arms 78, 84 to provide additional torque on the threaded, blowout preventer head 12 to break the initial engagement of the threads. A come along winch may also be attached to the torque arm to provide additional torque still.

The tool 10 may include one or more devices for holding the torque arms 78, 84 in a stored position when the tool 10 is being positioned or is not being used. For example, the first end 80 of the first torque arm 78 may be formed with an aperture 102 and a first anchor shackle 104 may be placed in the aperture 102. Then, when in the stored position, the first anchor shackle 104 may be used in conjunction with an anchor bar 106 (or anchor plate) on a medial portion 108 of the shaft 24 to secure the first torque arm 78 in a stored position as shown in FIG. 1. The anchor plate bar 106 may be formed with a first extension 109 having a first aperture 110 for receiving the first anchor shackle 104. Likewise, the second torque arm 84 may be formed with an aperture 112 and a second anchor shackle 114 disposed in part through the aperture 112. The second anchor shackle 114 is sized and configured to releasably couple to the anchor bar 106. For example, the second anchor shackle 114 may be coupled through an aperture 116 on a second extension 118 of the anchor bar 106. As shown best in FIG. 3, the anchor bar 106 may be formed with a central aperture 120 that is slide on the shaft 24 before being coupled, e.g., welded.

Referring to FIGS. 1-2 and 4, additional support for one or more torque arms may be supplied by forming a torque-arm-receiving channel for each torque arm. For example, a first plurality of brace members 122 may form a first torque-arm-receiving channel 124 for receiving a portion of the at least one torque arm when the tool 10 is in a torque position (FIG. 2). The first plurality of brace members 122 are coupled to the first side 40 of the head-mounting member 38. Thus, when the first torque arm 78 is in the torque position, the lateral edges of the first torque arm 78 substantially abut or otherwise engage a portion of the first plurality of brace members 122 and provide additional support for transferring of forces. Likewise, a second plurality of brace members 128 is coupled to the first side of the head-mounting member 38 to form a second torque-arm-receiving channel 130.

In operation according to one embodiment, an upper stack (not shown) is removed from the top of the blowout preventer 14 to expose the first side 20 of the threaded, blowout preventer head 12. One of the tools 10 for removing the threaded, blowout-preventer head 12 using a rotating device previously discussed is provided. The tool 10 is raised to the driller floor by attaching an air hoist line to the lifting eye member 30 and raising the tool 10. Once the tool 10 has been lifted to the driller floor, the air hoist line may be removed and then an elevator line or main hoist line may be attached to the tool 10 on the shaft 24 or lifting eye member 30.

The tool 10 is then moved through the turn table of the rig and positioned such that the second side 42 of the head-mounting member 38 is proximate the first side 20 of the threaded, blowout preventer head 12. The tool 10 is then bolted to the threaded, blowout preventer head 12 using studs 22. Then the rotating device, e.g., kelly or top drive, may be coupled to a portion of the shaft 24 to provide a rotating force to the tool 10. Supplemental torque may be provided by using tongs and a winch line or automatic rough neck (e.g., ST-80 Iron Roughneck from National Oilwell Varco of Houston, Tex.). The turning motion loosens the threaded, blowout preventer head 12 and allows the threaded, blowout preventer head 12 to be unscrewed and removed.

If the threaded, blowout preventer head 12 is too difficult to remove as describe, the initial turn of the threaded, blowout preventer head 12 may be accomplished with additional torque. In such a case, one or more torque arms 78, 84 may be rotated into the torque position, bolted down using apertures 94, 98 in the torque arms 94, 98 and apertures 96, 100 in the torque plate 60, and then force may be applied to provide additional torque. The additional force applied to the torque arms 78, 84 may be applied directly by human operators or may be applied using a pulling device, e.g., a come along winch, air or electric tugger hoist, air or electric winch, or other pulling device. As an alternative, a separate torque arm may be simply placed over apertures 96 or 100 and bolted into to position before having a force applied. As another alternative, a cable may be bolted to one of the apertures 44 not be occupied by a stud 22 or through an aperture in the torque plate (e.g., aperture 100) and then a force applied to the cable by a pulling device.

Once the threaded, blowout preventer head 12 is unscrewed from the mating threads of the blowout preventer 14, the threaded, blowout preventer head 12 may be lifted through the turn table of the rig and placed on the driller floor. The threaded, blowout preventer head 12 may remain attached to the tool 10 until the seals are replaced or other maintenance on the blowout preventer is complete. The threaded, blowout preventer head 12 may be set on the driller floor. After this, the tool 10 is used to lower the threaded, blowout preventer head 12 through the turn table and back onto the blowout preventer body 18. The rotating device may then be used to rotate the threaded, blowout preventer head 12 back onto the mating threads of the blowout preventer 14. The tool 10 is then unbolted and removed. The stack can then be attached to the threaded, blowout preventer head 12 and any lines attached.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A tool for removing a threaded, blowout-preventer head using a rotating device, the tool comprising:

a longitudinal shaft having a first end and a second end;

a lifting eye member coupled to the first end of the shaft;

a head-mounting member having a first side and a second side, wherein the head-mounting member is coupled to the second end of the longitudinal shaft, wherein the head-mounting member includes a plurality of apertures for receiving a plurality of studs on the threaded, blowout preventer head;

wherein the shaft and head-mounting member have a combined longitudinal length that allows a rotating device to be coupled to a portion of the shaft in order to rotate the shaft and remove the blowout preventer head; and wherein the head-mounting member comprises:

a mounting plate having the plurality of apertures and having a first side and a second side;

a plurality of gussets having a first edge and a second edge, wherein the second edges of the plurality of gussets are coupled to the first side of the mounting plate; and a torque plate having a first side and a second side, wherein the first edges of the plurality of gussets are coupled to the second side of the torque plate.

2. A tool for removing a threaded, blowout-preventer head using a rotating device, the tool comprising:

a longitudinal shaft having a first end and a second end;

a lifting eye member coupled to the first end of the shaft;

a head-mounting member having a first side and a second side, wherein the head-mounting member is coupled to the second end of the longitudinal shaft, wherein the head-mounting member includes a plurality of apertures for receiving a plurality of studs on the threaded, blowout preventer head;

wherein the shaft and head-mounting member have a combined longitudinal length that allows a rotating device to be coupled to a portion of the shaft in order to rotate the shaft and remove the blowout preventer head; and wherein the head-mounting member comprises:

a mounting plate having the plurality of apertures and having a first side and a second side;

a plurality of gussets having a first edge and a second edge, where the second edges of the plurality of gussets are coupled to the first side of the mounting plate;

a torque plate having a first side and a second side, wherein the first edges of the plurality of gussets are coupled to the second side of the torque plate;

wherein the shaft is coupled to the first side of the mounting plate;

wherein the shaft is greater than 5 feet in length and less than 20 feet in length;

wherein the mounting plate is separated from the torque plate by at least 10 inches and less than 30 inches.

3. A tool for removing a threaded, blowout-preventer head using a rotating device, the tool comprising:

a longitudinal shaft having a first end and a second end;

a lifting eye member coupled to the first end of the shaft;

a head-mounting member having a first side and a second side, wherein the head-mounting member is coupled to the second end of the longitudinal shaft, wherein the head-mounting member includes a plurality of apertures for receiving a plurality of studs on the threaded, blowout preventer head;

wherein the shaft and head-mounting member have a combined longitudinal length that allows a rotating device to be coupled to a portion of the shaft in order to rotate the shaft and remove the blowout preventer head; and further comprising at least one torque arm pivotally coupled to the first side of the head-mounting member and a plurality of brace members coupled to the first side of the head-mounting member to form a torque-arm-receiving channel for receiving a portion of the at least one torque arm when the tool is in a torque position.

4. A tool for removing a threaded, blowout-preventer head using a rotating device, the tool comprising:

a longitudinal shaft having a first end and a second end;

a lifting eye member coupled to the first end of the shaft;

a head-mounting member having a first side and a second side, wherein the head-mounting member is coupled to the second end of the longitudinal shaft, wherein the head-mounting member includes a plurality of apertures for receiving a plurality of studs on the threaded, blowout preventer head;

wherein the shaft and head-mounting member have a combined longitudinal length that allows a rotating device to be coupled to a portion of the shaft in order to rotate the shaft and remove the blowout preventer head; and wherein the head-mounting member comprises:

a mounting plate having the plurality of apertures and having a first side and a second side;

a plurality of gussets having a first edge and a second edge, wherein the second edges of the plurality of gussets are coupled to the first side of the mounting plate;

a torque plate having a first side and a second side, wherein the first edges of the plurality of gussets are coupled to the second side of the torque plate; and at least one torque arm pivotally coupled to the first side of the head-mounting member.

5. A tool for removing a threaded, blowout-preventer head using a rotating device, the tool comprising:

a longitudinal shaft having a first end and a second end;

a lifting eye member coupled to the first end of the shaft;

a head-mounting member having a first side and a second side, wherein the head-mounting member is coupled to the second end of the longitudinal shaft, wherein the head-mounting member includes a plurality of apertures for receiving a plurality of studs on the threaded, blowout preventer head;

wherein the shaft and head-mounting member have a combined longitudinal length that allows a rotating device to be coupled to a portion of the shaft in order to rotate the shaft and remove the blowout preventer head; and wherein the tool further comprises:

at least one torque arm pivotally coupled to the first side of the head-mounting member;

an anchor bar coupled to a medial portion of the shaft on an exterior;

wherein the at least one torque arm has a first end and a second end, and wherein the first end of the at least one torque arm has an aperture and an anchor shackle in the aperture, wherein the second end of the at least one torque arm is coupled to a hinge that is coupled to the first side of the head-mounting member;

wherein the anchor bar is coupled to the shaft in a location to mate with the anchor shackle on the torque arm to hold the at least one torque arm in a stored position when the at least one torque arm is in a stored position.

6. A tool for removing a threaded, blowout-preventer head using a rotating device, the tool comprising:

a longitudinal shaft having a first end and a second end, wherein the shaft is at least 8 feet long and is less than 25 feet long, wherein the shaft is a pipe having an outside diameter greater than four inches and less than 10 inches and a wall thickness greater than ½ inch and less than three inches;

a lifting eye member coupled to the first end of the shaft, wherein the lifting eye member comprises a lifting eye plate coupled to a base plate;

a head-mounting member having a first side and a second side, wherein the head-mounting member is coupled to the second end of the longitudinal shaft, wherein the head-mounting member includes a plurality of apertures for receiving a plurality of studs on the blowout preventer head;

wherein the shaft and head-mounting member have a combined longitudinal length that allows a rotating device to be coupled to a portion of the shaft in order to rotate the shaft and remove the blowout preventer head;

wherein the head-mounting member comprises:

a mounting plate having the plurality of apertures and having a first side and a second side;

a plurality of gussets having a first edge and second edge, wherein the second edges of the plurality of gussets are coupled to the first side of the mounting plate, and a torque plate having a first side and a second side, wherein the first edges of the plurality of gussets are coupled to the second side of the torque plate;

a first torque arm pivotally coupled to the first side of the head-mounting member, the first torque arm having a first end and a second end;

a second torque arm pivotally coupled to the first side of the head-mounting member and spaced approximately 180 degrees from the first torque arm, the second torque arm having a first end and a second end;

an anchor bar coupled to a medial portion of the shaft on an exterior, the anchor bar having a first extension with an aperture and as second extension with an aperture;

wherein the first end of the first torque arm has an aperture and a first anchor shackle in the aperture, wherein the first end of the second torque arm has an aperture and a second anchor shackle in the aperture;

wherein the second end of the first torque arm is coupled to a first hinge that is coupled to the first side of the head-mounting member;

wherein the second end of the second torque arm is coupled to a second hinge that is coupled to the first side of the head-mounting member;

wherein the anchor bar is positioned and configured such that the aperture in the first extension mates with the first anchor shackle on the first torque arm to hold the first torque arm in a stored position and configured so that the aperture in the second extension mates with the second anchor shackle on the second torque arm to hold the second torque arm in a stored position;

wherein a first plurality of apertures is formed proximate the second end of the first torque arm for aligning with a first plurality of apertures formed in the torque plate when the tool is in the torque position;

wherein a second plurality of apertures is formed proximate the second end of the second torque arm for aligning with the second plurality of apertures formed in the torque plate when the tool is in the torque position;

a first plurality of brace members coupled to the first side of the head-mounting member to form a first torque-arm-receiving channel for receiving a portion of the first torque arm when the tool is in a torque position; and a second plurality of brace members coupled to the first side of the head-mounting member to form a second torque-arm-receiving channel for receiving a portion of the second torque arm when the tool is in a torque position.

* * * * *